US010180011B2

(12) United States Patent
White

(10) Patent No.: US 10,180,011 B2
(45) Date of Patent: Jan. 15, 2019

(54) POST SUPPORT APPARATUS

(71) Applicant: Jarrod Conway White, Auckland (NZ)

(72) Inventor: Jarrod Conway White, Auckland (NZ)

( * ) Notice: Subject to any disclaimer, the term of this patent is extended or adjusted under 35 U.S.C. 154(b) by 0 days.

(21) Appl. No.: 15/508,353

(22) PCT Filed: Sep. 1, 2015

(86) PCT No.: PCT/NZ2015/050126
§ 371 (c)(1),
(2) Date: Mar. 2, 2017

(87) PCT Pub. No.: WO2016/036259
PCT Pub. Date: Mar. 10, 2016

(65) Prior Publication Data

US 2017/0284120 A1 Oct. 5, 2017

(30) Foreign Application Priority Data

Sep. 2, 2014 (NZ) ..... 629890

(51) Int. Cl.
*E04H 12/22* (2006.01)
*E04H 17/22* (2006.01)

(52) U.S. Cl.
CPC ..... *E04H 12/2215* (2013.01); *E04H 12/2261* (2013.01); *E04H 12/2276* (2013.01); *E04H 17/22* (2013.01)

(58) Field of Classification Search
CPC .... E04B 1/40; E04B 2001/405; E04B 1/4114; E04B 1/41; E04H 12/2253;
(Continued)

(56) References Cited

U.S. PATENT DOCUMENTS 90,611 A * 5/1869 Unger ..... E04H 12/2269 52/298
239,080 A * 3/1881 Baker ..... E04H 12/2269 52/298

(Continued)

FOREIGN PATENT DOCUMENTS

AU 18386/01 2/2001
CA 2741848 11/2012

(Continued)

OTHER PUBLICATIONS

International Search Report for PCT/NZ2015/050126 dated Sep. 15, 2016.

(Continued)

*Primary Examiner* — Adriana Figueroa
*Assistant Examiner* — Jessie T Fonseca
(74) *Attorney, Agent, or Firm* — Young & Thompson

(57) ABSTRACT

A post, column or pile support apparatus for fixing a post end to a substrate which includes support member between upper and lower plate members. The support member is connected between the upper and lower plate members and includes a central post member and at least two wall plate member. The upper plate member provides an upper outer planar surface to support at least an end of a post. A wall member is provided which is connected to the upper plate member opposite to the support member to provide an upwardly oriented perimeter wall forming at least one recess therein for the sliding receipt of an end of a post, column or pile. The lower plate member is shaped to be supported by and connected to the substrate. The wall plate members have at least one aperture being adapted to allow reinforcing there through and around.

16 Claims, 5 Drawing Sheets

(58) Field of Classification Search
CPC . E04H 12/2269; E04H 12/2238; E04H 12/22; E02D 27/42; E02D 27/016; E02D 27/013; E02D 27/01
See application file for complete search history.

(56) References Cited

U.S. PATENT DOCUMENTS

| | | | | |
|---|---|---|---|---|
| 1,676,266 | A | 7/1928 | Kearney | |
| 1,879,414 | A | 9/1932 | Munoz | |
| 3,302,909 | A | 2/1967 | Glassman | |
| 3,514,959 | A | 6/1970 | Dougherty | |
| 3,691,776 | A | 9/1972 | Hull | |
| 3,727,357 | A | 4/1973 | Stillman | |
| 3,762,672 | A | 10/1973 | Tabbert | |
| 3,809,346 | A | 5/1974 | Jackson | |
| 3,915,434 | A | 10/1975 | Lister | |
| 4,269,010 | A | 5/1981 | Glass | |
| 4,295,308 | A | 10/1981 | Korfanta | |
| 4,829,732 | A | 5/1989 | Dahowski et al. | |
| 4,860,940 | A | 8/1989 | Mills | |
| 4,862,656 | A | 9/1989 | Kelly | |
| 4,914,875 | A | 4/1990 | Gustafson | |
| 4,972,642 | A | 11/1990 | Strobl, Jr. | |
| 4,995,206 | A | 2/1991 | Colonias et al. | |
| 5,065,975 | A | 11/1991 | Giles | |
| 5,123,623 | A * | 6/1992 | McNamara | E04H 12/2253 248/156 |
| 5,307,598 | A | 5/1994 | West | |
| 5,560,588 | A * | 10/1996 | Hilliard | E04G 21/3223 256/59 |
| 5,632,464 | A * | 5/1997 | Aberle | E04H 12/2269 248/530 |
| 5,695,166 | A | 12/1997 | Watts | |
| 5,791,096 | A | 8/1998 | Chen | |
| 5,816,554 | A * | 10/1998 | McCracken | E04F 15/02458 248/346.01 |
| 5,899,030 | A | 5/1999 | Barefield | |
| 6,712,330 | B1 * | 3/2004 | Damiano | E04H 12/2261 248/519 |
| 6,729,089 | B1 * | 5/2004 | Spragg | E04H 12/2238 248/346.03 |
| 6,851,234 | B2 | 2/2005 | Hoffman et al. | |
| 6,980,888 | B2 | 12/2005 | Baker et al. | |
| 7,273,198 | B2 | 9/2007 | Tourtellotte et al. | |
| 7,380,561 | B2 | 6/2008 | Nobert et al. | |
| 7,594,782 | B2 | 9/2009 | Smith et al. | |
| 7,610,728 | B1 | 11/2009 | Manocchia | |
| 8,408,845 | B2 | 4/2013 | Hutchinson | |
| 9,234,323 | B2 | 1/2016 | Gerrard et al. | |
| 9,238,922 | B2 | 1/2016 | Intagliata et al. | |
| 2004/0172898 | A1 | 9/2004 | Knepp | |
| 2006/0101877 | A1 | 5/2006 | Orum et al. | |
| 2006/0108495 | A1 | 5/2006 | Walker et al. | |
| 2007/0084137 | A1 | 4/2007 | Pasto | |
| 2012/0085050 | A1 | 4/2012 | Greenwood | |
| 2013/0175422 | A1 | 7/2013 | Clarke | |
| 2013/0312340 | A1 | 11/2013 | Miller et al. | |
| 2015/0108318 | A1 | 4/2015 | Orr | |
| 2016/0076208 | A1 | 3/2016 | Gerrard et al. | |
| 2017/0016243 | A1 | 1/2017 | Testa et al. | |
| 2017/0022679 | A1 | 1/2017 | Hayman | |
| 2017/0101760 | A1 * | 4/2017 | Seay | E02D 27/42 |
| 2018/0002943 | A1 * | 1/2018 | Jensen | E04H 12/2238 |
| 2018/0016808 | A1 * | 1/2018 | Hilliard | E04H 12/2238 |

FOREIGN PATENT DOCUMENTS

| | | |
|---|---|---|
| CA | 2801524 | 7/2013 |
| CN | 201134656 | 10/2008 |
| CN | 201459753 | 5/2010 |
| CN | 201661104 | 12/2010 |
| CN | 202073113 | 12/2011 |
| CN | 103397637 | 11/2013 |
| CN | 103967035 | 8/2014 |
| CN | 203835021 | 9/2014 |
| CN | 104088499 | 10/2014 |
| CN | 204435407 | 7/2015 |
| CN | 204608989 | 9/2015 |
| CN | 204803773 | 11/2015 |
| CN | 204804437 | 11/2015 |
| CN | 204940325 | 1/2016 |
| CN | 205046928 | 2/2016 |
| DE | 19530061 | 2/1997 |
| DE | 20313190 | 2/2004 |
| EP | 1529903 | 5/2005 |
| FR | 2367868 | 5/1978 |
| FR | 2497919 | 7/1982 |
| FR | 2769648 | 9/2001 |
| GB | 511249 | 8/1939 |
| GB | 1078622 | 8/1967 |
| GB | 1138339 | 1/1969 |
| GB | 2283994 | 5/1995 |
| GB | 2388380 | 11/2003 |
| GB | 2456331 | 7/2009 |
| GB | 2468939 | 9/2010 |
| GB | 2508313 | 5/2014 |
| JP | H03-260224 | 11/1991 |
| JP | 2000-136652 | 5/2000 |
| JP | 3764114 | 4/2006 |
| JP | 4080706 | 4/2008 |
| KR | 10-2010-0018378 | 2/2010 |
| KR | 10-0942995 | 2/2010 |
| KR | 10-2011-0007887 | 1/2011 |
| KR | 10-2011-0032971 | 3/2011 |
| KR | 10-2011-0058601 | 6/2011 |
| KR | 10-2012-0006857 | 1/2012 |
| KR | 10-1147925 | 5/2012 |
| KR | 20-0462729 | 9/2012 |
| KR | 10-1408770 | 6/2014 |
| KR | 10-1614129 | 4/2016 |
| NZ | 586811 | 11/2011 |
| WO | 86/01849 | 3/1986 |
| WO | 97/32089 | 9/1997 |
| WO | 2004/016886 | 2/2004 |
| WO | 2015/112026 | 7/2015 |
| WO | 2016/059657 | 4/2016 |

OTHER PUBLICATIONS

Building a House Footing Systems, by Charles Simpson & Barry Hodgson, Jan. 2009, p. 20.

"SubBase Timber Pile Support," http://www.trademe.co.nz/Browse/Listing.aspx?id=1128421004, retrieved Jul. 27, 2016.

"TuffBlock Instant Foundation System" Brochure, https://cdn.shopify.com/s/files/1/1125/5528/files/TB_Bunnings_TearSheet.pdf?16451761057168508325, retrieved Jul. 27, 2016.

* cited by examiner

POST SUPPORT APPARATUS

The present invention relates to a support for a post or post end and to a method of installation. The invention is directed particularly but not solely towards providing a support for a post, column or pile prior to concreting in place by providing a more stable support.

BACKGROUND OF INVENTION

In construction, supporting or suspending posts, columns or piles or similar in concrete, above or in a substrate such as for example the ground, is a common time consuming problem. The end or base of such a post, column or pile is required to not sit directly on the ground due to possible moisture entry which can be detrimental to the post by causing a loss of strength or stability due to rot.

Traditional attempts to solve the problem of base support are by a variety of methods such as by grabbing anything close to hand to provide a gap or spacing from the ground. This sort of approach is somewhat haphazard which can cause delay in the construction process. Typical methods of construction include using various items such as rocks, stones, gravel or even putting in a loose mix of 'site concrete' which may or may not be available. Also these items tend to have an uneven shape, making it very difficult to support the post without outside assistance with props or hand support to be strictly level and/or upright. Pouring concrete afterwards can also move the post out of alignment. These methods cause the need to regularly check the position of the post and adjust accordingly.

Another problem with using items as they can be found to hand on site, is that they can not be properly tied or linked to the concrete further adding to some instability to the post and proper keying in. Typically these methods are haphazard in nature and time consuming All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein; this reference does not constitute an admission that any of these documents form part of the common general knowledge in the art, in New Zealand or in any other country.

OBJECT OF THE INVENTION

It is an object of the invention to provide post support apparatus and method of installation that ameliorates some of the disadvantages and limitations of the known art or at least provide the public with a useful choice.

SUMMARY OF INVENTION

Accordingly in a first aspect the invention consists in a post, column or pile support apparatus for fixing at least a post end to a substrate, the apparatus including at least one support member, upper plate member, and lower plate member, wherein the support member is connected between the upper and lower plate members and includes at least one central post member and at least two wall plate members, wherein the upper plate member provides an upper outer planar surface for the resting thereon and supporting of at least an end of a post, wherein, a wall member is provided which is connected to the upper plate member opposite to the support member to provide an upwardly oriented perimeter wall forming at least one recess therein for the sliding receipt of an end of a post, column or pile wherein the apparatus fixes and supports the post end prior to receiving concrete there around, wherein the perimeter wall of the recess is shaped to provide a continuously surrounding wall, and the wall plate members radiate vertically outwardly from the central post support member wherein the central post support member and wall plate members extend at least between the upper and lower plate members. (as transferred from first old preferment).

Preferably the wall plate members are provided with at least one aperture being adapted to allow reinforcing there through, wherein the apparatus is shaped to support the post end prior to receiving concrete and/or reinforcing there around and/or there through.

Preferably, the upper plate member includes at least one fastening aperture there through which is adapted to provide means for a fastener to be connected through the post support apparatus, to the post, the lower plate member being shaped to be supported by and connected to the substrate and at least one aperture is provided in the lower plate member, to allow at least one pin, peg or stake to be inserted there through and driven into the substrate to provide suitable support for the post support apparatus, Preferably ribs or protrusions are provided at a lower end of wall support members 41 wherein one rib or protrusion is provided on each side of the wall support members.

Preferably the upper and lower plate members have a major plane oriented in a substantially horizontal plane.

Preferably, the upper plate member is similar in shape and dimensions to the lower plate member.

Preferably, the central post member has a square cross section with side faces and corners wherein the wall plate members extend vertically from each corner.

Alternatively, the lower plate member is larger in area than the upper plate member wherein the wall plate members have an outwardly sloping end edge wall.

Preferably, the upper plate member and lower plate member are square shaped and the support member has a square cross section, having corners and end edges.

Preferably, the upper plate member and lower plate member are circular shaped and the support member has a circular cross section.

Preferably, the perimeter wall is a planar member which is vertically oriented.

Alternatively the wall member is provided by at least two L shaped members are movably attached to the upper plate member which are positioned to provide a wall forming a space there between for the receipt of the end of the post wherein at least one of the L shaped members is adjustable in position to allow for difference diameter or width of a post.

Preferably the L shaped members are provided as corner shaped members.

Preferably the L shaped member is formed having a vertical arm hingedly attached to a horizontal arm, whereby the vertical arm is a flap member.

Preferably, the wall member includes at least one fastening aperture there through which is adapted to provide means for a fastener to be connected through the post support apparatus, to the post.

Alternatively the wall member includes comprises a sleeve shaped member which includes a continuous upright wall shaped to provide a space there between for receipt of the end of the post.

Preferably, the upper plate member, lower plate member, central post member and wall plate members are joined together by welding.

Preferably the central post member has a circular cross section with side faces wherein the wall plate members extend vertically from the side faces being spaced peripherally there around.

Preferably, at least one drainage aperture can be provided in, at least the lower plate member and/or upper plate member.

Preferably, the upper plate member, lower plate member, central post member and wall plate members are formed of metal or plastics.

Preferably the reinforcing can be selected from concrete, steel rods, or steel cabling.

Preferably the substrate can be selected from a ground, a hole in the ground or a boxed hole on the ground, floor or suspended surface.

Preferably the recess as located between the perimeter wall includes a floor as represent by a portion of the upper plate member which extends between a base of the perimeter walls Preferably the central post member is a hollow member providing an open end toward the upper plate member.

Accordingly in a second aspect the invention consists in a method of installing a post support apparatus as described in the first aspect of the present invention, the post support apparatus including a support member, upper and lower plate members and wall plate members, wherein the support member is connected between the upper and lower plate members, and the wall plate members radiate vertically outwardly from the support member and extend between the upper and lower plate members, wherein the upper plate member provides an upper outer planar surface for the resting thereon and supporting of an end of a post and the lower plate member is adapted to be supported by a substrate, the method including the following steps of:

1. Prepare substrate (eg ground or hole) by levelling with an appropriate base;
2. Assemble post to the post support apparatus;
3. Place post and apparatus on ground or base of hole;
4. Level and plumb the post to requirements;
5. Attach reinforcing if required;
6. Pour concrete around post support apparatus.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

BRIEF DESCRIPTION

The invention will now be described, by way of example only, by reference to the accompanying drawings:

FIG. 1 is an upper perspective view in accordance with a first preferred embodiment of the invention.

FIG. 2 is a top plan view

FIG. 3 is a first side view

FIG. 4 is corner side view

FIG. 5 is a second side view

FIG. 6 is a third side view

FIG. 7 is a fourth side view

FIG. 8 is a bottom plan view

FIG. 9 is an upper perspective view in accordance with a second preferred embodiment of the invention.

FIG. 10 is a top plan view

FIG. 11 is a first side view

FIG. 12 is corner side view

FIG. 13 is a second side view

FIG. 14 is a third side view

FIG. 15 is a fourth side view

FIG. 16 is a bottom plan view

FIG. 17 is an upper perspective view in accordance with a third preferred embodiment of the invention.

FIG. 18 is a top plan view

FIG. 19 is a first side view

FIG. 20 is corner side view

FIG. 21 is a second side view

FIG. 22 is a third side view

FIG. 23 is a fourth side view

FIG. 24 is a bottom plan view

FIG. 25 is an upper perspective view in accordance with a fourth preferred embodiment of the invention.

FIG. 26 is a top plan view

FIG. 27 is a first side view

FIG. 28 is corner side view

FIG. 29 is a second side view

FIG. 30 is a third side view

FIG. 31 is a fourth side view

FIG. 32 is a bottom plan view

FIG. 33 is an upper perspective view in accordance with a fifth preferred embodiment of the invention.

FIG. 34 is a top plan view

FIG. 35 is a first side view

FIG. 36 is corner side view

FIG. 37 is a second side view

FIG. 38 is a third side view

FIG. 39 is a fourth side view

FIG. 40 is a bottom plan view

FIG. 41 is an upper perspective view of another embodiment of the invention.

DESCRIPTION OF DRAWINGS

The following description will describe the invention in relation to preferred embodiments of the invention, namely a post support apparatus 1 for fixing and supporting at least a post end to a substrate prior to being concreted with or without suitable reinforcing. The invention is in no way limited to these preferred embodiments as they are purely to exemplify the invention only and that possible variations and modifications would be readily apparent without departing from the scope of the invention.

Figures 1, 2, 3, 4, 5, 6, 7, 8:
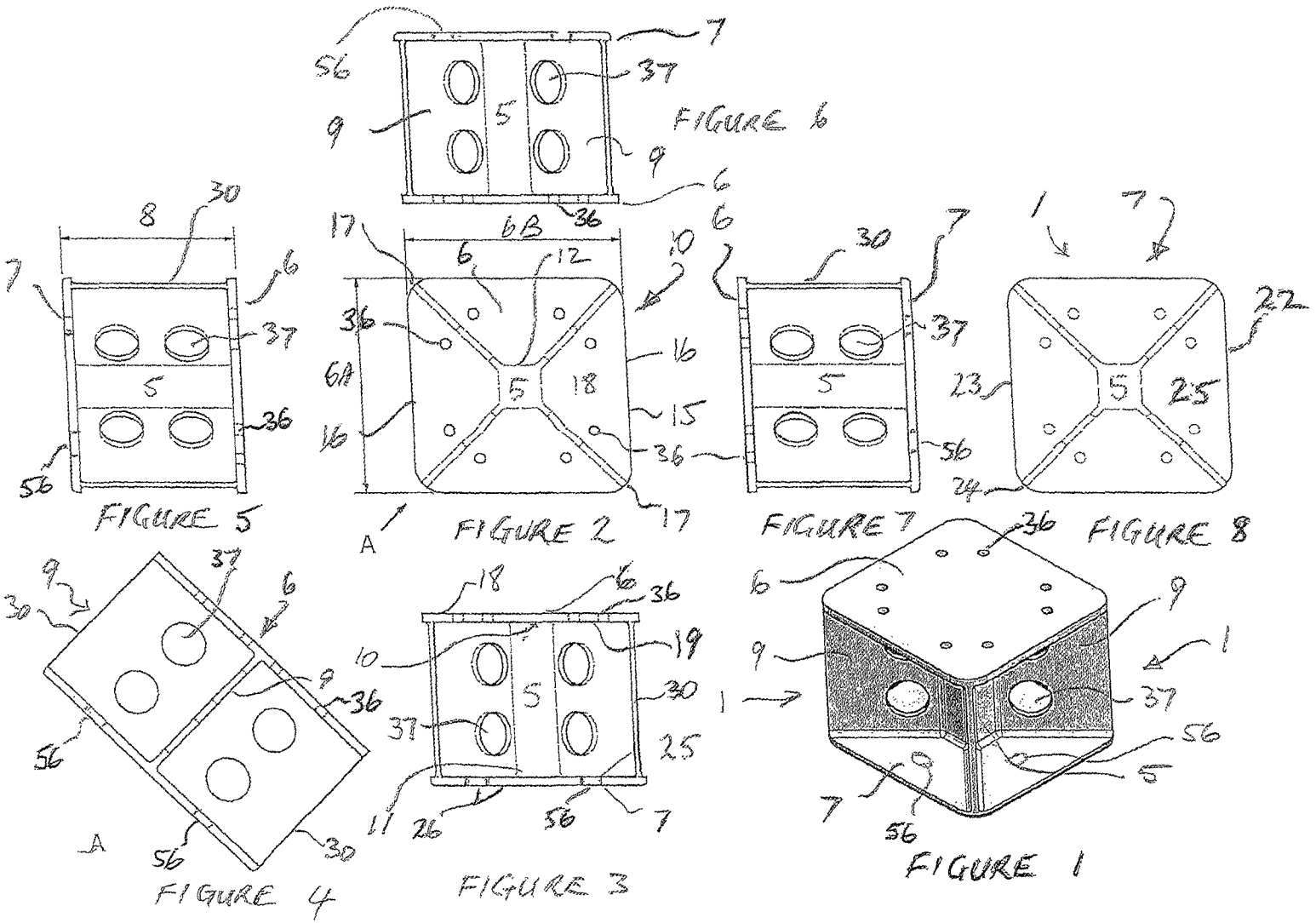
FIGS. 1-40 shows post support apparatus 1 in three different embodiments.

First Embodiment—FIGS. 1-8

FIGS. 1-8 show a first embodiment of the post support 1 which includes a body having at least one support member 5, upper and lower plate members 6 & 7. In use at least a portion of an end of any post is adapted to be positioned to at least rest and be supported on the upper plate member 6 whereas the lower plate member is shaped and adapted to rest or be fixed to the substrate eg the ground or floor. An outer shape of the post support apparatus 1 is adapted to receive concrete there around.

The post support member is joined or connected between an upper plate member 6 and lower plate member 7 and can be located centrally of an area of the upper and lower plate members 6 and 7. In use support member 5 has a length or height commensurate with a vertical axis, the upper and lower plate members 6 & 7 each having a major substantially horizontal plane commensurate with a planar surface, which are, when in use, substantially horizontally oriented.

The support member includes at least one central post member 5 and at least two wall plate members 9. The wall plate members 9 are also joined or connected or at least abut between upper plate member 6 and lower plate member 7 and radially extend vertically from four equidistant spaced circumferential positions on an outside of central post member 5. If the central post member 5 is a square cross section with side faces and corners, the wall plate members 9 extend radially from each corner or if the cross section is circular the wall plate members extend in a spaced peripheral pattern.

Upper and lower plate members 6 & 7 and the wall plate members 9 and any other component of this invention, are formed of 'plate' which means that they are planar members having a thickness much less than its length dimension having outer planar surfaces and perimeter end edge. Upper plate member 6 provides an upper outer planar surface for the resting thereon and supporting of an end of a post to support the post. Upper and lower plate members 6 &7 are oriented at right angles to wall plate members 9.

Post support member 5 is an elongate upright member having a top end 10, bottom end 11 and four sides 12. Upper plate member 6 is shown as a planar member having a perimeter edge 15 with four sides 16 with four corners 17, an upper surface 18 and lower surface 19 and area. Bottom plate member 7 can have similar dimensions to the upper plate member and is also formed as a planar shape member having an area with a perimeter edge 22, with four sides 23 with four corners 24, an upper surface 25 and lower surface 26. Wall plate members 9 can also be formed of planar shaped members with side end edges 30, top end edges 31, bottom end edges 32, upper wall outer surface 33 and lower wall outer surface 34.

A height 8 is defined extending from an outer upper surface 18 to a lower outer surface 34 which can be for example 100 mm.

At least one fixing apertures 36 can be provided in upper plate member 6 which extend completely through the planar member from upper surface 18 to lower surface 19 to be located between the wall plate members 9. For example eight fixing apertures 36 are provided. Fixing apertures 36 are designed to allow entry and fixing of suitable fasteners there through to attach a lower end of at least one post (not shown) to the post support 1. Wall plate members 9 has at least one wall aperture 37 which extend through first wall outer surface 33 to second wall outer surface 34 to provide a passage of suitable reinforcing such as concrete and/or metal bars, or flexible or deformable elongate members such as for example cables or rods.

Figures 9, 10, 11, 12, 13, 14, 15, 16:
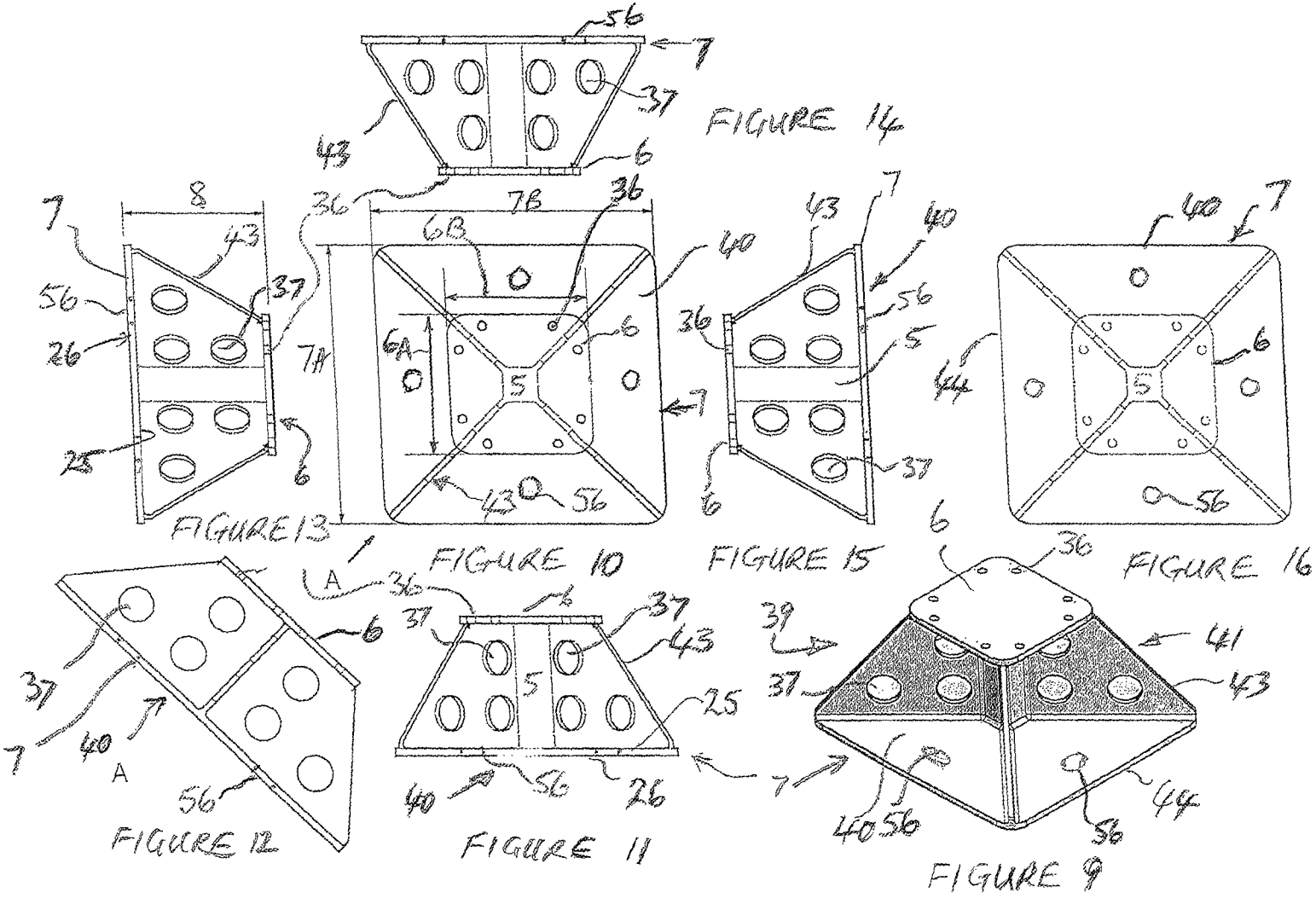

Second Embodiment FIGS. 9-16

As shown in FIGS. 9-16 there is disclosed a support post apparatus 39 having a bottom plate 40 which is shaped and dimensioned to be much larger in area than the area of upper plate member 6. This means that wall plate members 41 instead of having vertical end edges 30 they are angled end edges 43 to angle outwardly and downwardly to extend from upper plate end edge 16 to lower plate end edge 44. Other features such a surfaces, edges and apertures are similarly labelled as per FIGS. 1-8.

Figures 17, 18, 19, 20, 21, 22, 23, 24:
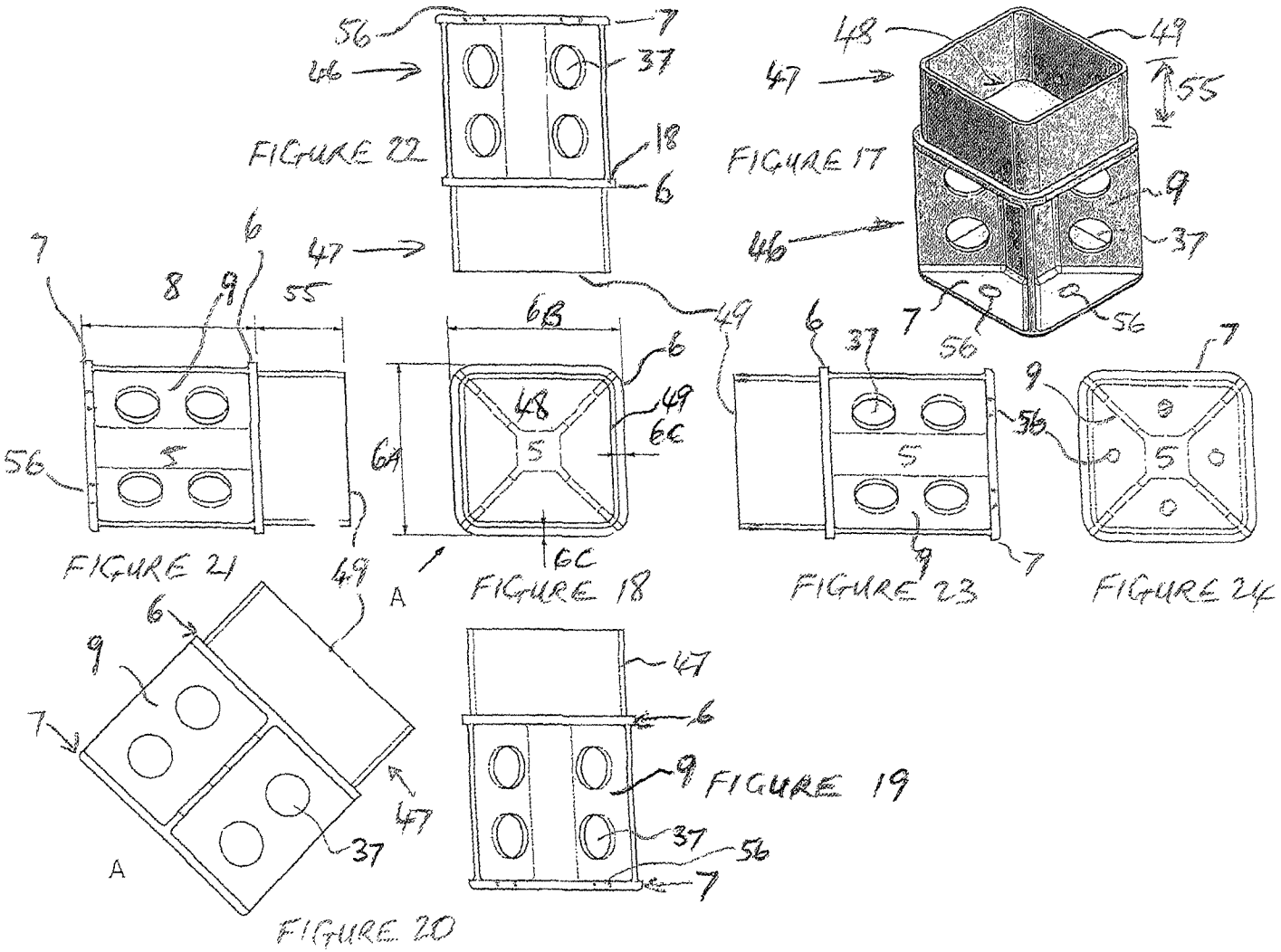

Third Embodiment FIGS. 17-24

There is shown a support post apparatus 46 which has a different method of fixing at least one post ie instead of or combined with fixing apertures 36 there is provided a wall member in the form of at least spaced perimeter walls or as a continuous perimeter wall as a sleeve member 47 which is attached or connected to upper surface 18 of upper plate member 6. The perimeter wall 47 is a planar member oriented in a vertical plane. Sleeve member 47 comprises a perimeter wall dimensioned to provide at least one recess 48 for sliding receipt of an end of at least one post or column, top end edge 49 with outer surface 50 and inner surface 51. As seen in the figures the sleeve member 47 can be dimensioned to be less than the area of the upper plate member 6 ie to be inwardly recessed from outer edge 22. Sleeve member 47 has a sleeve height 55 defined from outer surface 18 to top end edge 49 which can be for example 50 mm The recess as located between the perimeter wall 47 includes a floor as represented by a portion of the upper plate member 6 which extends between a base of the perimeter walls 47.

Figures 25, 26, 27, 28, 29, 30, 31, 32:
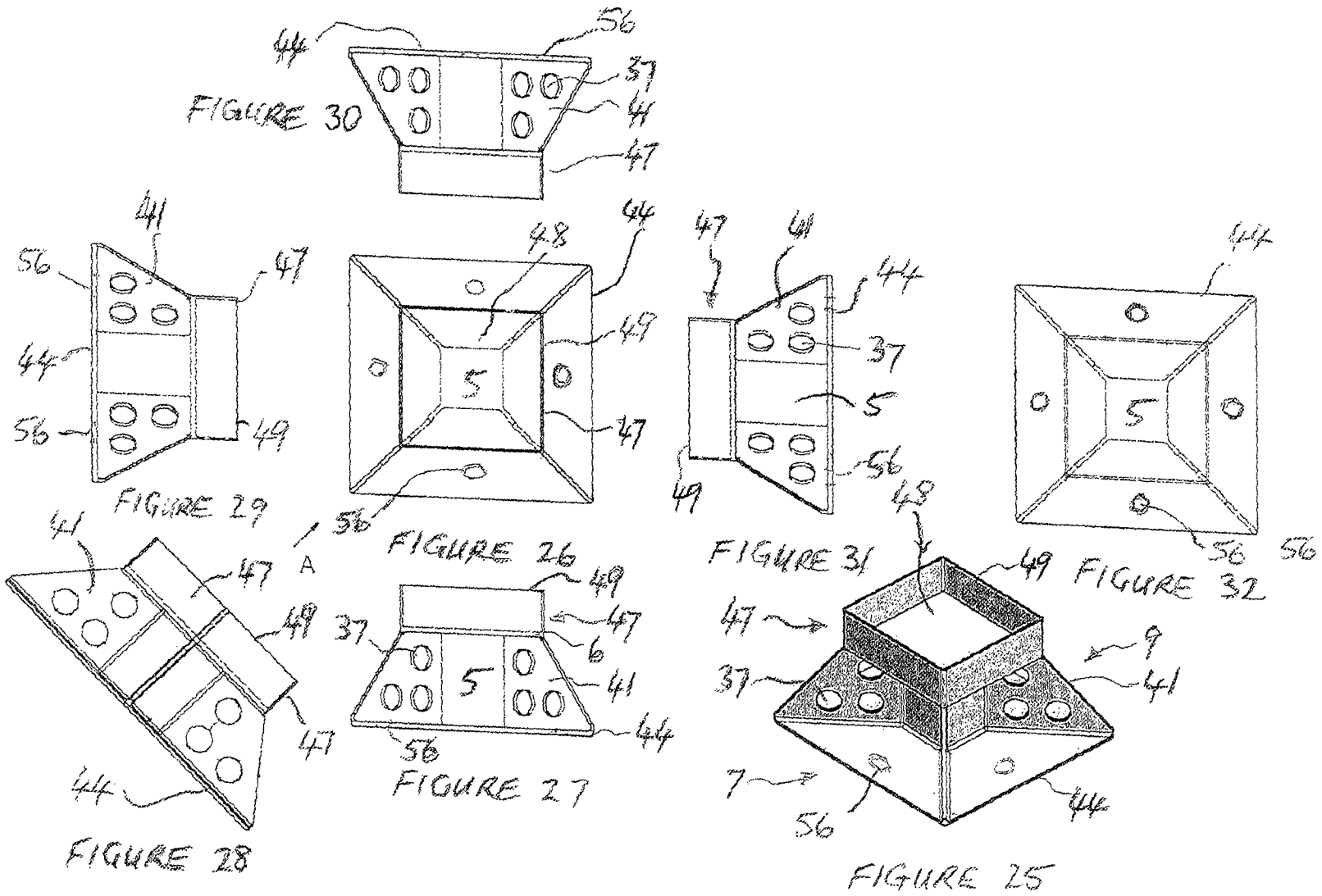

Fourth Embodiment FIGS. 25-32

Fourth embodiment is similar to an upper portion of the third embodiment and includes a lower portion similar to the second embodiment. The upper portion includes upper plate member 6 with sleeve member 47 sitting on thereof and positioned at a periphery thereof and forming an upstanding wall with a top end edge 49. The lower plate member 7 is made larger in area than the upper plate member 6 whereby the lower portion includes a wall plate members 9 shaped with an outer angled edge beginning from a top adjacent to a peripheral edge of the upper plate member 7, angling outwardly and downwardly to a peripheral edge of the lower plate member 7.

Figures 33, 34, 35, 36, 37, 38, 39, 40:
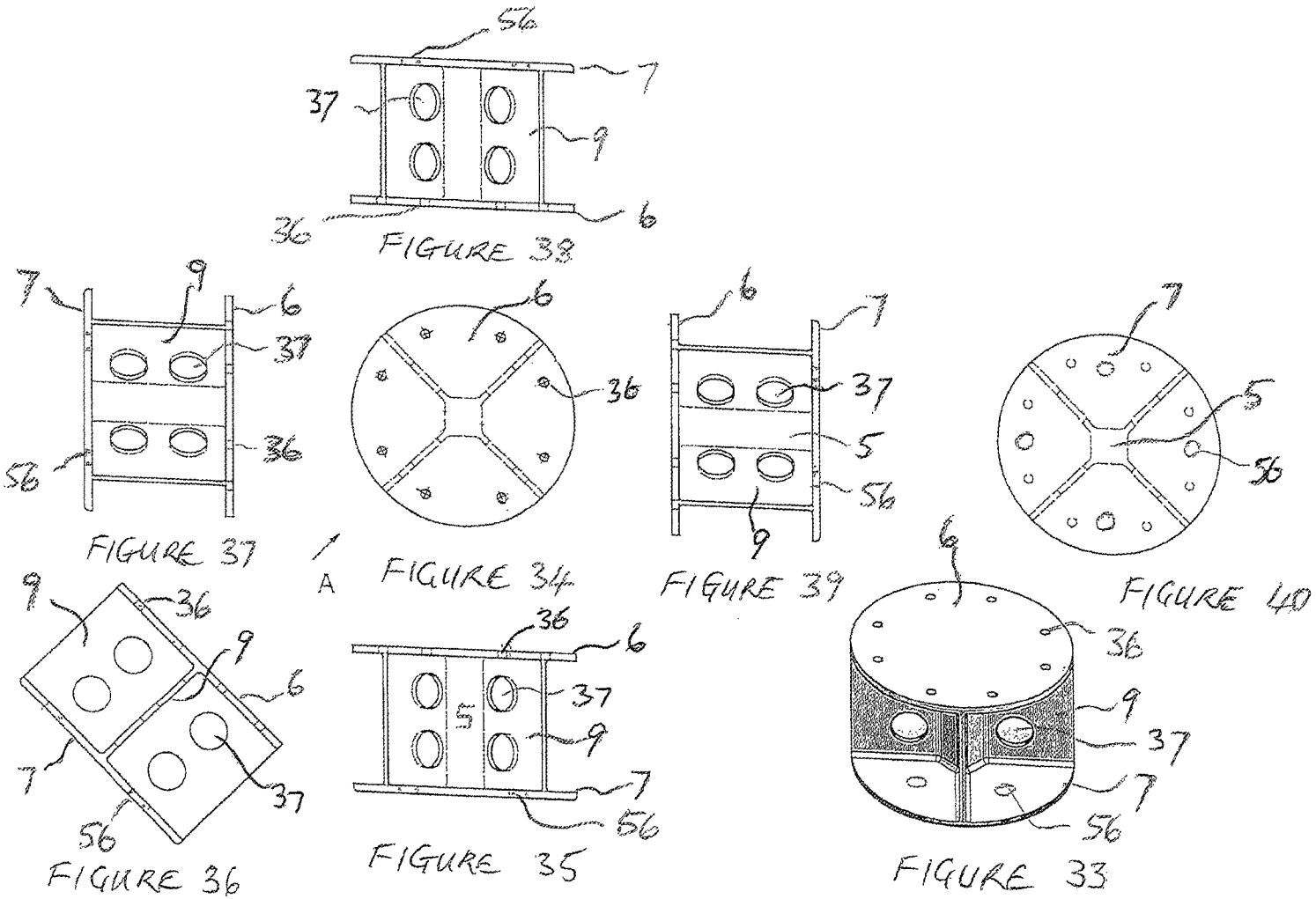

Fifth Embodiment FIGS. 33-40

The fifth embodiment is very similar to the first embodiment but this time includes a circular shaped upper plate member 6 and lower plate member 7 with central post member 5 and wall plate members 9 with apertures 37. Wall plate members 9 extend from a peripheral edge of upper plate member 6 to an end edge of a peripheral edge of the lower plate member 7.

In all embodiments of the post support member 1, upper plate member 6 includes at least one fixing aperture 36 and lower plate member 7 has at least one fixing aperture 56. Additionally sleeve member 47 of FIGS. 19-24 and 25-32 can also include at least one fixing aperture, though this is not shown in these figures. Furthermore all wall plate members 9, 41 of all embodiments include at least one aperture 37 for the passage of reinforcing.

In all embodiments upper plate member 6 can also include drainage means (not shown) in the form of at least one drainage aperture whereby any moisture that either drops or seeps onto outer surface can be directed or allowed to pass through the upper plate member 6. Lower plate member 7 can also have at least one aperture (not shown) there through to provide a means for drainage away from the support apparatus 1 and/or provide a means in the form an aperture 56 for the insertion of at least one pin, peg or stake (not shown) having a head, to be pushed or driven downwardly through the aperture whereby the head of the pin is not able to pass through the aperture, to then hold the lower plate member 7 and support apparatus 1 in place One Method of Installation 1. Prepare substrate eg ground or hole by levelling with an appropriate base;
2. Assemble post to the post support apparatus;
3. Place post and apparatus on ground or base of hole;
4. Level and plumb the post to requirements;
5. Attach reinforcing in the form of steel if required;
6. Pouring concrete around post support apparatus.

Method can be varied such as for example by first attaching the post to the apparatus and then placing in hole or by concreting the apparatus in the hole first and then attach the post.

Yet Another Method can Include the Following Steps of:

1. Dig or drill hole to specified depth and diameter;
2. Ensure base of hole is suitably level;
3. If base of hole is not level add amount of sand or fine aggregate;
4. Take post support apparatus and insert or abut to an end of a post;
5. Screw suitable fasteners to through post support apparatus to connect post to the apparatus;
6. Take post with connected apparatus and position on base in hole;
7. Plumb the post into correct line;
8. Insert pegs through fixing apertures in lower plate member of the apparatus and driven in to secure post in correct position to the base of the hole;
9. Place reinforcing through apertures in wall plate members 9;
10. Mix and place concrete in hole;
11. Vibrate concrete to enable good coverage.

Optional Advantages a) simple use or
b) modest cost or
c) quick installation or
d) easy to manufacture or
e) robust construction or
f) able to knit with concrete or
g) attachable to the post or column or
h) post or column is stably mounted or
i) able to level and orient post or column or
j) keeps base of post or column above ground or moisture.

Variations

Throughout the description of this specification, the word "comprise" and variations of that word such as "comprising" and "comprises", are not intended to exclude other additives, components, integers or steps. Central post 5, upper plate member 6, lower plate member 7 wall plate members 9, 41 and sleeve 47 can be attached to each other by any suitable means such as for example by welding, clipping or bolting together. Furthermore, central post 5, upper plate member 6, bottom plate member 7, wall plate members 9, 41 and sleeve member 47 can be formed from any suitable material such as for example metal such as galvanised steel or plastics. Furthermore all components can be of any shape or size and of any material combination and type.

A post can be said to mean any elongate member requiring end support which can also mean a member that is part of some other part or member eg leg of a table or platform or any structure. The post need not be solid and can be hollow or made up of parts. There can be more than one post, pile or column supported by the apparatus including more than one recess 48. The perimeter wall of the sleeve member 47 need not be continuous but can have gaps or apertures therein or have partitioning therein and positioning prong(s) with in the recess 48 or upper surface of upper plate member 6. There can also be more than one support member with no central post support member 5 with just wall plate members 9 intersecting or not at a middle or even just having wall plate members 9 positioned in a radiating pattern or in a peripheral pattern or in any pattern both continuous or in discrete sections.

The post can also be any structure that has an elongate member or any type of elongate member needing to be positioned, fixed to the apparatus and then the apparatus being tied down by for example being concreted or cemented in place and/or tied down like for example utilizing reinforcing including cabling, reinforcing steel, or flexible resilient or ductile elongate members suitable for purpose like for example ties or chords of steel or plastics. The size of the post support apparatus 1 can be varied to suit whatever sized post, pile or column there is, ie the thickness, height, width and number of any of the components of the apparatus 1 can be varied. For example the number and shape of wall plate members 9 or 41 can be adjusted.

The upper plate member 6 is shaped minimally providing a planar surface 18 with end post fixing which can also include being in the form of a sleeve with apertures or simply a movable wall eg L shaped which between the movable walls form a space for the post of any shape depending on at least the outer shape of the post which can be for example, circular, square, triangular, rectangular or simply polygonal. The post need not be solid or one piece and can be hollow and be made of any type of material such as for example wood, steel, aluminium, concrete or plastics or any combination thereof. As shown by the figures the upper plate member 6 can be a different shape to the lower plate member 7, the wall member 47, support member 5 and wall plate members 9 can be different shapes or be similar to each other in any combination.

Fixing of the end of the post to the apparatus can be by separate fasteners like for example screws, bolts, rivets or pins, through appropriate apertures through the wall members 47 and/or upper plate member 6, which can be combined or replaced with adhesive or alternatively by welding or by a friction fit. Underneath lower plate member 7 protuberance(s) or surface roughness can be provided to aid in fixing or stability. For example, the protuberances or roughness can be in the form of ribbing, blades or individual downwardly protruding prongs or spikes.

Furthermore central post member 5 of the apparatus can be formed as a solid member or as a hollow member with optional internal vertical walls with an upper end being open or not through upper plate member 6. At least one drainage aperture can also be provided at the base of the hollow space of the central post member 5. The central post member 5 can be adjustable eg by being telescoping or be made in parts.

Other variations in the post support apparatus include having the fixing of the post end being adjustable such as having the wall member 47 formed as at least one movable substantially L shaped member(s) (not shown) movably or slidably located on a track in or on the upper plate member 6 whereby the L shaped members can be adjustably moved radially or outwardly from a centre of the upper plate member 6 to allow for different sized and shaped post ends. The L shaped member includes in use, a horizontal arm and vertical arm. The vertical arm includes at least one aperture for fixing a fastener there through to the side of an end of the post. The horizontal arm is slidably and adjustably fixed to the upper plate member, which for example can include a slotted portion or a ratcheted mechanism to allow sliding of the L shaped member and fixing in a certain position.

At least two such L shaped members forming a space there between for an end portion of an end of the post can form a minimum so that four L shaped members might also provide a useful means of fixing the end of the post. Additionally the L shaped members can also be provided as corner members for the end of the post.

Also the L shaped member can be formed with a hinge between the horizontal; and vertical arms so that the vertical arm can be adjustably rotated about the hinge like a flap or folding member to be positioned to abut an outer peripheral surface of the end of the post to allow suitable fixing there through. The hinge can be a separate hinge member or be a 'living type' hinge.

Yet other variations in the use of the post support apparatus 1 is that the substrate can include the follow options of a ground, a hole, a floor, a boxed hole located on the ground or floor or suspended floor or slab or even be part of a floor slab or foundations when being constructed or being made. The hole can be formed on top of a substrate and be in form of a raised formwork boxed area. The pins, pegs or stakes used to hold down the lower plate member of the post support member can be simple elongate members that can be driven into the ground relying on friction or they can be screwed or bolted in place or ever cast in place or even can use flexible ties to hold down the lower plate member to the substrate.

Furthermore an inside of the wall members 47 or upper plate member 6 can have protruding spike(s) or blade(s) etc adapted to protrude upwardly and/or sideways into the bottom of the post, to aid in any friction fit of the post end, if required. Ribs or protrusions can be provided on any of the parts or components of the apparatus to assist in the keying in of the concrete.

It will also be understood that where a product, method or process as herein described or claimed and that is sold incomplete, as individual components, or as a "kit of Parts", that such exploitation will fall within the ambit of the invention. The shape of upper and lower plate members 6 & 7 are shown as being planar members having a square shape in area having a certain thickness dimension much less than the side lengths dimension. For example area of 6A(100 mm)×6B(100 mm) with a height 8 of 100 mm as seen in FIGS. 1-8 and plate thickness 6C of 5 mm, 7A×7B ie 200×200 mm for lower plate member of FIGS. 9-16 or 6A(100 mm)×6B(100 mm) for FIGS. 17-24) but other planar shapes are equally possible such as rectangular or circular.

These and other features and characteristics of the present invention, as well as the method of operation and functions of the related elements of structures and the combination of parts and economics of manufacture, will become more apparent upon consideration of the following description with reference to the accompanying drawings, all of which form part of this specification, wherein like reference numerals designate corresponding parts in the various figures.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

For purposes of the description hereinafter, the terms "upper", "lower", "right", "left", "vertical", "horizontal", "top", "bottom", "lateral", "longitudinal", "side", "front", "rear" and derivatives thereof shall relate to the invention as it is oriented in the drawing figures. However it is to be understood that the invention may assume various alternative variations, except where expressly specified to the contrary. It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

The drawing number references and named components can be used for like components where appropriate covering all embodiments.

What I claim is:

1. A post, column or pile support apparatus for fixing a post end to a substrate and vertical support loading of the post, column or pile, the apparatus including at least one support member, upper plate member, and lower plate member, the support member is connected between the upper and lower plate members and includes at least one central post member and at least two wall plate members, the upper plate member provides an upper outer planar surface for the resting thereon and supporting of at least an end of a post, a wall member is provided which is connected to the upper plate member opposite to the support member to provide an upwardly oriented perimeter wall forming at least one recess therein for the sliding receipt of an end of a post, column or pile, the at least one central post member or the at least two wall plate members of the apparatus when in use is capable of structurally vertically supporting the post end prior to receiving concrete and/or reinforcing there around and there through, wherein at least the perimeter wall of the recess is shaped to provide surrounding wall, and the wall plate members radiate vertically outwardly from the central post support member and the central post member and wall plate members extend only between the upper and lower plate members.

2. A post, column or pile support apparatus for fixing to a substrate as claimed in claim 1 wherein ribs or protrusions are provided at a lower end of wall support members (41) wherein one rib or protrusion is provided on each side of the wall support members.

3. A post, column or pile support apparatus for fixing to a substrate as claimed in claim 2 wherein the upper and lower plate members have a major plane oriented in a substantial horizontal plane.

4. A post, column or pile support apparatus for fixing to a substrate as claimed in claim 3 wherein, the central post member has a square cross section with side faces and corners wherein the wall plate members extend vertically from each corner.

5. A post, column or pile support apparatus for fixing to a substrate as claimed in claim 4 wherein, the lower plate member is larger in area than the upper plate member wherein the wall plate members have an outwardly sloping end edge wall.

6. A post, column or pile support apparatus for fixing to a substrate as claimed in claim 4 wherein the upper plate member and lower plate member are square shaped and the support member has a square cross section, having corners and end edges.

7. A post, column or pile support apparatus for fixing to a substrate as claimed in claim 4 wherein the upper plate member and lower plate member are circular shaped and the support member has a circular cross section.

8. A post, column or pile support apparatus for fixing to a substrate as claimed in claim 5 wherein the perimeter wall is a planar member which is vertically oriented.

9. A post, column or pile support apparatus for fixing to a substrate as claimed in claim 5 wherein the wall member is provided by at least two L shaped members are movably attached to the upper plate member which are positioned to provide a wall forming a space there between for the receipt of the end of the post wherein at least one of the L shaped members is adjustable in position to allow for a difference in diameter or width of a post.

10. A post, column or pile support apparatus for fixing to a substrate as claimed in claim 9 wherein the L shaped members are provided as corner members.

11. A post, column or pile support apparatus for fixing to a substrate as claimed in claim 10 wherein each L shaped member is formed having a vertical arm hingedly attached to a horizontal arm, whereby the vertical arm is a flap member.

12. A post, column or pile support apparatus for fixing to a substrate as claimed in claim 8 wherein, the wall member includes at least one fastening aperture there through which is adapted to provide means for a fastener to be connected through the post support apparatus, to the post.

13. A post, column or pile support apparatus for fixing to a substrate as claimed in claim 3 wherein, the central post member has a circular cross section with side faces wherein the wall plate members extend vertically from the side faces being spaced peripherally there around.

14. A post, column or pile support apparatus for fixing to a substrate as claimed in claim 13 wherein at least one drainage aperture is provided in, at least the lower plate member and/or in the upper plate member.

15. A post, column or pile support apparatus for fixing to a substrate as claimed in claim 14 wherein the recess as located between the perimeter wall includes a floor as represented by a portion of the upper plate member which extends between a base of the perimeter wall.

16. A post, column or pile support apparatus for fixing to a substrate as claimed in claim 15 wherein the central post member is a hollow member providing an open end in through the upper plate member.

* * * * *